US006142836A

United States Patent [19]

Deckmann et al.

[11] Patent Number: 6,142,836

[45] **Date of Patent: *Nov. 7, 2000**

[54] TERMINAL

[75] Inventors: Heinrich Deckmann, Langenselbold; Hans-Georg Vögler, Frankfurt; Alfred Wolf, Florstadt, all of Germany

[73] Assignee: Hartmann & Braun GmbH & Co. KG, Eschborn, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/995,792

[22] Filed: Dec. 22, 1997

[51] Int. Cl.[7] ..... H01R 4/30

[52] U.S. Cl. ..... 439/801; 439/83

[58] Field of Search ..... 439/77, 78, 83, 439/775, 792, 793, 794, 795, 797, 799, 800, 801; 361/736, 743, 808

[56] References Cited

U.S. PATENT DOCUMENTS

| | | | |
|---|---|---|---|
| 4,310,214 | 1/1982 | Carlson | 439/801 |
| 4,650,274 | 3/1987 | Schmid | 439/801 |
| 4,678,250 | 7/1987 | Romine et al. | 439/83 |
| 5,439,398 | 8/1995 | Testa et al. | 439/801 |
| 5,574,629 | 11/1996 | Sullivan | 361/767 |
| 5,833,479 | 11/1998 | Talbot | 439/83 |

*Primary Examiner*—Lincoln Donovan
*Attorney, Agent, or Firm*—Michael M. Rickin

[57] ABSTRACT

A terminal, in particular for electronic printed circuit boards, with which contact can be made with the printed circuit board in a materially connecting fashion. In order to obtain, in a terminal arrangement of this type, a more suitable, simpler and statically stable means of making contact, the terminal has at the bottom a planar, solderable bottom face as connecting face, and the printed circuit board has a corresponding, metallized area as solder face only on its upper side to which the terminal can be soldered.

15 Claims, 1 Drawing Sheet

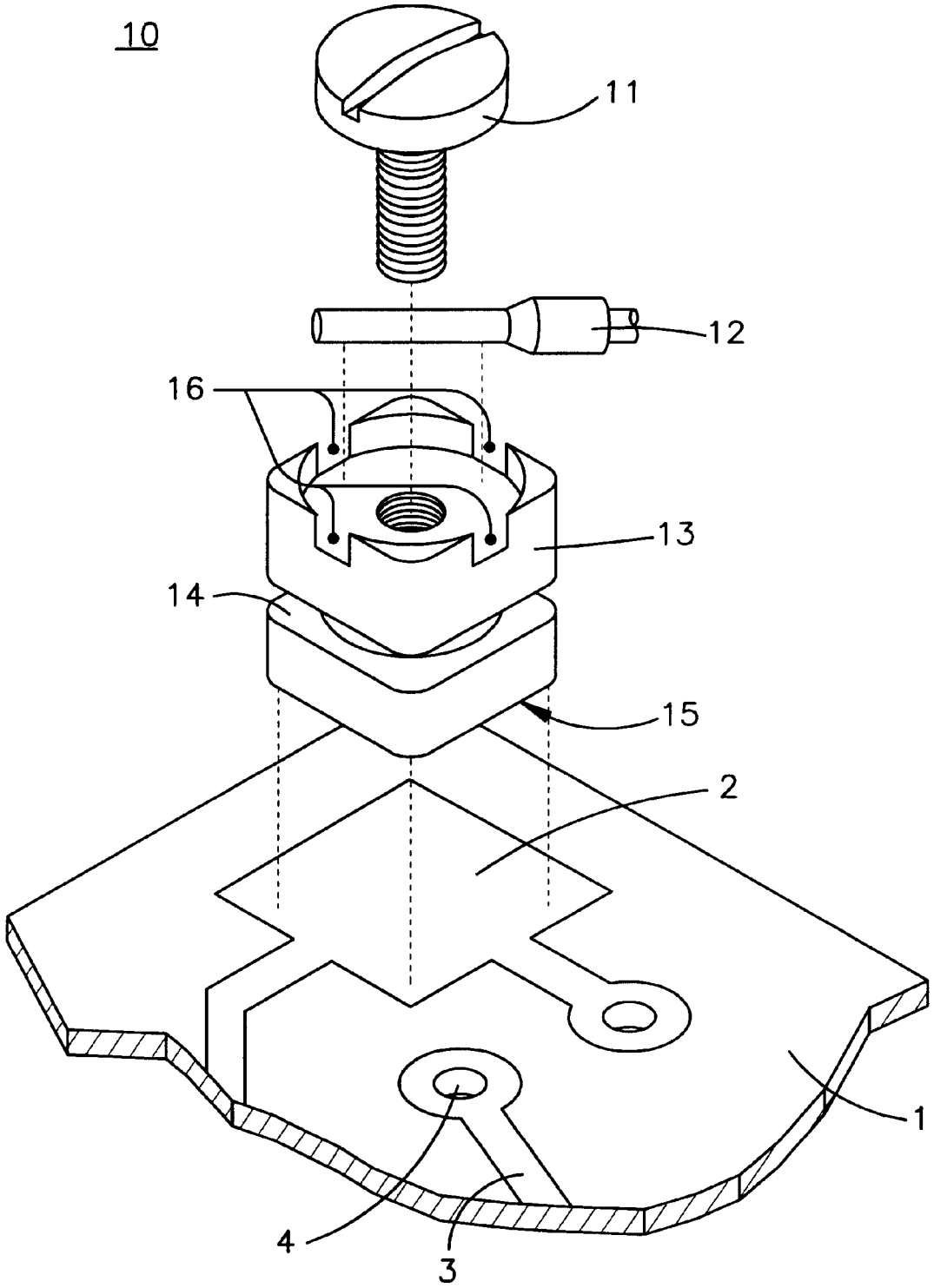
10
11
12
16
13
14
15
2
1
4
3

TERMINAL

FIELD OF THE INVENTION

This invention relates to a terminal, and more particularly a terminal for electronic printed circuit boards, with which contact can be made with the printed circuit board in a materially connecting fashion.

DESCRIPTION OF THE PRIOR ART

Terminals are used to produce contact points between an electronic printed circuit board and electric lines which have been led in from outside. It is known to provide the printed circuit boards with through holes at the appropriate points. Terminals of a known type are provided with a base on which connection pins which can be soldered at the bottom are arranged. These terminals are then plugged through the appropriate through holes with the pins and are soldered permanently into place from that side of the printed circuit board which faces away.

External lines can be secured to the terminals themselves usually by means of screw-clamping elements. When these screw-clamping elements are tightened, high torsional and shearing forces sometimes occur which have to be statically checked exclusively by the relatively thin connection pins of the terminal.

Furthermore, when known terminals are used, the printed circuit board must have the hole pattern of the terminal on both sides, which takes up a lot of space, in particular with the multilayer arrangements.

Taking this as a basis, the invention is based on the object of providing a means of making contact with the terminal which is more suitable, simpler and statically stable.

SUMMARY OF THE INVENTION

The object which has been set is achieved according to the invention with a terminal of the generic type in that the terminal has a planar connection face at the bottom and the printed circuit board has a corresponding solder face only on its upper side to which the terminal can be soldered. The further refinement is that the terminal is in a number of pieces and is composed of a solderable bottom element which can be soldered to the solder face of the printed circuit board, and a terminal part is provided as an upper part which can be connected to the bottom element by means of the same screw with which the connecting cable can be secured to the terminal.

In a further advantageous refinement of the invention, the upper part, i.e. the actual terminal, is provided with upwardly open slots for inserting cables, by means of which slots the cable to be clamped in position is held under the clamping screw in a reliably contact-making manner. By virtue of the aforesaid slots, the terminal is given an upwardly pointing, crown-shaped contour.

The terminal arrangement according to the invention is markedly easier to mount by virtue of it being in a number of pieces. Thus, the printed circuit board is initially prepared with an appropriate number of metallized areas. Then, the bottom part of the terminal firstly is soldered onto said areas without the rest of the structure of the terminal getting in the way in this working procedure because, of course, said structure has not yet been mounted. Only after the solder connection has been made is the upper part of the terminal connected to the soldered-on bottom part by means of the aforesaid screw with which the connecting cable is also secured. This ensures a connection which is very reliable both electrically and mechanically.

A significant feature is also that the metallized area on the printed circuit board is only on the upper side of said printed circuit board. That is to say, the usual mechanical soldering of components is carried out from underneath the printed circuit board and the soldering on of the terminal is performed independently on the upper side of the printed circuit board. As a result, the working procedure of the soldering on of the components is independent of the soldering on of the terminal, which is advantageous in terms of production technology.

DESCRIPTION OF THE DRAWING

The terminal of the present invention is illustrated in the only drawing figure.

DESCRIPTION OF THE PREFERRED EMBODIMENT(S)

The drawing shows the entire terminal arrangement 10 together with a detail which shows part of a printed circuit board 1. The printed circuit board has, as is known, conductor tracks 3 which are provided at defined points with through holes 4 for receiving and soldering on electronic components. At a defined point, the printed circuit board has a metallized area 2 which is electrically connected to one of the conductor tracks and which has to be connected to the terminal according to the invention. That is to say, this metallized area 2 on the printed circuit board 1 is already part of the entire terminal arrangement according to the invention.

The terminal has a terminal bottom part 14 which has at the bottom a solderable face 15, with which the terminal bottom part 14 can be soldered onto the metallized area 2 of the printed circuit board 1. A terminal upper part 13 which can be connected to the terminal bottom part 14 through the connecting screw 11 is also provided. The connecting screw 11 has a double function here; firstly to make this aforesaid connection of the upper and bottom parts, and at the same time it keeps secured the connecting cable 12 which has been inserted into the terminal upper part 13. The terminal upper part 13 is provided here with upwardly open cable insertion slots 16. These keep the connecting cable 12 in a fixed position.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A terminal for mounting on a circuit board comprising:

a first part having a bottom face which is solderable to said circuit board and a top face opposed thereto and a fastener passageway extending partially therethrough from said top face towards said bottom face;

a second part having a bottom face and a top face opposed thereto and a fastener passageway extending entirely therethrough from said top face to said bottom face; and a fastener for passage through said second part fastener passageway and into said first part fastener passageway to thereby bring said first part top face and said second part bottom face into direct face to face contact with each other when said terminal is assembled, said fastener also for keeping secured to said second part top face at least one external electrical conductor.

2. The terminal of claim 1 wherein said second part top face has at least one upwardly open slot for insertion of said at least one external electrical conductor so that said at least one external electrical conductor can be secured to said second part top face by said fastener.

3. In combination, a circuit board comprising a metallized area only on one side of said circuit board; and a terminal comprising:

a first part having a bottom face which is solderable to said metallized area only on one side of said circuit board and a top face opposed thereto and a fastener passageway extending partially therethrough from said top face towards said bottom face;

a second part having a bottom face and a top face opposed thereto and a fastener passageway extending entirely therethrough from said top face to said bottom face; and a fastener for passage through said second part fastener passageway and into said first part fastener passageway to thereby bring said first part top face and said second part bottom face into direct face to face contact with each other when said terminal is assembled, said fastener also for keeping secured to said second part top face at least one external electrical conductor.

4. The terminal of claim 3 wherein said second part top face is provided with at least one upwardly open slot for insertion of said at least one external electrical conductor so that said at least one external electrical conductor can be secured to said second part top face by said fastener.

5. The terminal of claim 1 wherein said fastener has a head and said at least one external electrical conductor is clamped between said fastener head and said second part top face.

6. The terminal of claim 5 wherein said fastener is a screw.

7. The terminal of claim 2 wherein said fastener has a head and said at least one external electrical conductor is clamped between said fastener head and said second part top face.

8. The terminal of claim 7 wherein said fastener is a screw.

9. The terminal of claim 3 wherein said fastener has a head and said at least one external electrical conductor is clamped between said fastener head and said second part top face.

10. The terminal of claim 9 wherein said fastener is a screw.

11. The terminal of claim 4 wherein said fastener has a head and said at least one external electrical conductor is clamped between said fastener head and said second part top face.

12. The terminal of claim 11 wherein said fastener is a screw.

13. A method for connecting at least one electrical conductor to a circuit board using a terminal having a first part, a second part and a fastener which are each separate and apart from each other, said method comprising the steps of:

a) providing at least one metallized area on a top face of said circuit board;

b) mounting said terminal to said at least one metallized area comprising the steps of:

(i) soldering a bottom face of said first part to said at least one metallized area; and (ii) bringing a bottom face of said second part into direct face to face contact with a top face of said first part by said fastener, said fastener going entirely through said second part and only partway through said first part; and c) securing said at least one electrical conductor between said fastener and a top face of said second part.

14. The method of claim 13 wherein said fastener is a screw having a head and said at least one electrical conductor is clamped between said screw head and said top face of said second part.

15. The method of claim 14 wherein said top face of said second part has at least one upwardly extending slot and said at least one electrical conductor is threaded through said slot.

* * * * *